United States Patent [19]

Charlton

[11] Patent Number: 4,579,376

[45] Date of Patent: Apr. 1, 1986

[54] FAIL-SECURE AND FAIL-SAFE DOOR LOCK MECHANISM

[75] Inventor: Newton W. Charlton, Thousand Oaks, Calif.

[73] Assignee: Security Engineering, Inc., Forestville, Conn.

[21] Appl. No.: 589,453

[22] Filed: Mar. 14, 1984

[51] Int. Cl.[4] ..... E05C 1/06

[52] U.S. Cl. ..... 292/144; 292/244; 292/170; 292/182; 292/69

[58] Field of Search ..... 292/144, 170, 182, 244, 292/DIG. 53, DIG. 69

[56] References Cited

U.S. PATENT DOCUMENTS

| | | | |
|---|---|---|---|
| 1,434,373 | 11/1922 | Crompton et al. | 292/170 |
| 1,462,805 | 7/1923 | Gibson | 292/170 X |
| 1,952,393 | 3/1934 | Tigue | 292/144 X |
| 3,360,970 | 1/1968 | Hays, Jr. | 292/144 X |
| 3,751,086 | 8/1973 | Geringer | 292/144 |
| 3,828,592 | 8/1974 | Horgan, Jr. | 292/170 X |
| 3,893,723 | 7/1975 | Boule | 292/170 X |
| 4,099,752 | 7/1978 | Geringer | 292/144 |

FOREIGN PATENT DOCUMENTS

| | | | |
|---|---|---|---|
| 159279 | 6/1957 | Sweden | 292/144 |

*Primary Examiner*—Richard E. Moore

*Attorney, Agent, or Firm*—Prutzman, Kalb, Chilton & Alix

[57] ABSTRACT

An electrical door lock device for alternate fail-secure and fail-safe operation comprising an elongated housing for mounting in a door or frame member, a bolt slidably mounted in the housing for movement between a first position and a second position with the first position being a projected locking position and the second position being a retracted nonlocking position, an actuator plate for driving the bolt between the first and second positions with the plate being movably mounted within the housing for movement between first and second positions and operationally connected to the bolt for driving the bolt to one of the first and second positions upon movement of the plate from the first position to the second position and for driving the bolt to the other of the first and second positions upon movement of the plate from the second position to the first position, a solenoid assembly for electrically actuating the plate from the first position to the second position, and a spring for normally biasing the plate toward the first position.

27 Claims, 5 Drawing Figures

26
26
16

60
62
68
24
76
70
74
56
54
12
32
36
20
33
34
22
18
40
38
32
28
42
33
50
30
44
46
52
58
48
26

10
26
26
16

14
62
24
76
68
70
74
54
20
22
33
30
28
33
40
38
42
50
44
52
58
48
26

FAIL-SECURE AND FAIL-SAFE DOOR LOCK MECHANISM

BACKGROUND AND SUMMARY OF THE INVENTION

This invention relates to electric door lock mechanisms and more particularly to fail-secure and fail-safe lock mechanisms.

In high security areas such as banks, computers rooms, museums, etc., electrically actuated door locks of either the fail-secure or fail-safe type are employed. For such applications, it is often preferable that the lock mechanism be mounted in a conventional, narrow door stile or frame member and, therefore, it is necessary that the lock be relatively narrow, shallow, and compact.

In fail-safe electric door locks, a locking condition is attained upon energizing the electric lock mechanism and an unlocking condition is attained by deenergizing the electric lock mechanism. Thus, a power failure or the like results in an unlocked condition, i.e., fail-safe. Conversely, in fail-secure electric door locks, a locking condition is attained upon deenergizing the electric lock mechanism and an unlocking condition is attained by energizing the electric lock mechanism. Thus, a power failure or the like results in a locked condition, i.e., fail-secure. In both fail-secure and fail-safe electric door locks, it is desirable to provide automatic deadlocking of the bolt in a projected "locking" position to resist jimmying of the lock.

It is a principal object of this invention to provide an improved door lock mechanism that attains both fail-secure and fail-safe operation.

A further object of the invention is to provide an electric door lock mechanism for fail-secure and fail-safe applications which automatically deadlocks in the projected locking position.

A still further object of the invention is to provide an electric door lock mechanism for fail-secure or fail-safe applications with manual mechanical retraction of the bolt in a fail-secure application and manual mechanical projection of the bolt in a fail-safe application.

Yet another object of the invention is to provide fail-secure and fail-safe electrical door lock mechanism that is economical to manufacture, versatile and durable in use, and refined in appearance.

All other objects will be in part obvious and in part pointed out more in detail hereinafter.

DESCRIPTION OF THE PREFERRED EMBODIMENT

The electric door lock mechanism of the present invention is generally designated by the numeral 10 and is convertible from a fail-secure mode (shown in FIG. 1) to a fail-safe mode (shown in FIG. 3) by the inversion of a single element, namely the actuator cam plate 12, as explained in more detail hereinafter.

Figure 1:
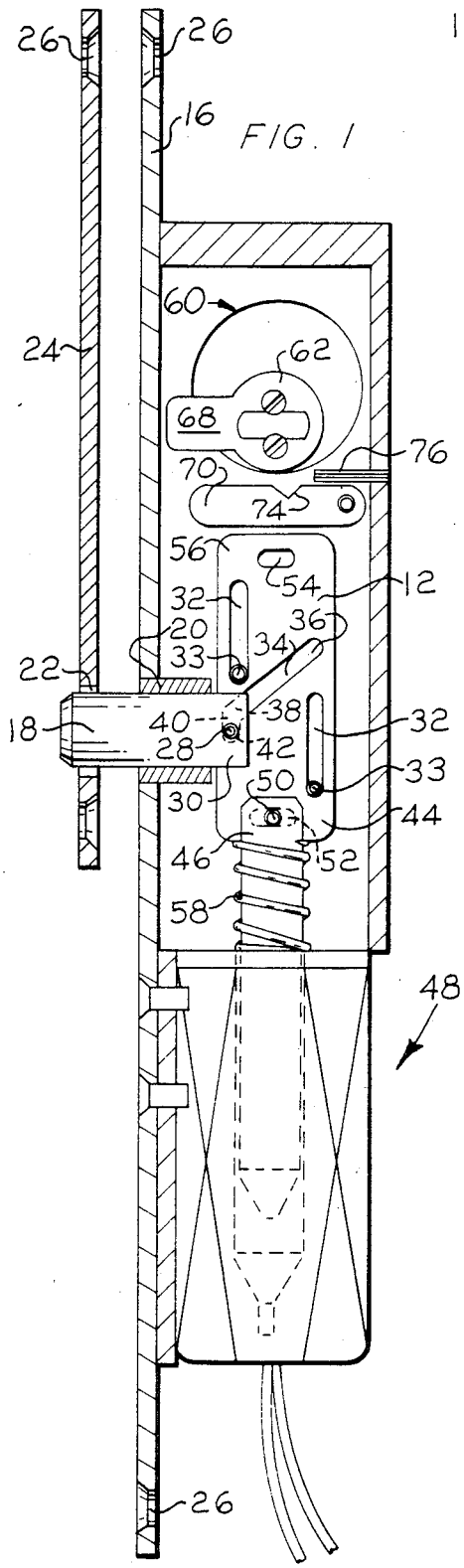
FIG. 1 is a sectional view of the electric door lock mechanism of the present invention in a fail-secure mode with the bolt in a projected locking position.

Referring initially to the fail-secure configuration of FIG. 1, the door lock mechanism 10 includes an elongated, narrow housing assembly 14 with a lockfront or plate 16. The housing assembly 14 is dimensioned and configured for mounting in a conventional, narrow door stile or frame member wherein the depth limitation is significant.

Figure 2:
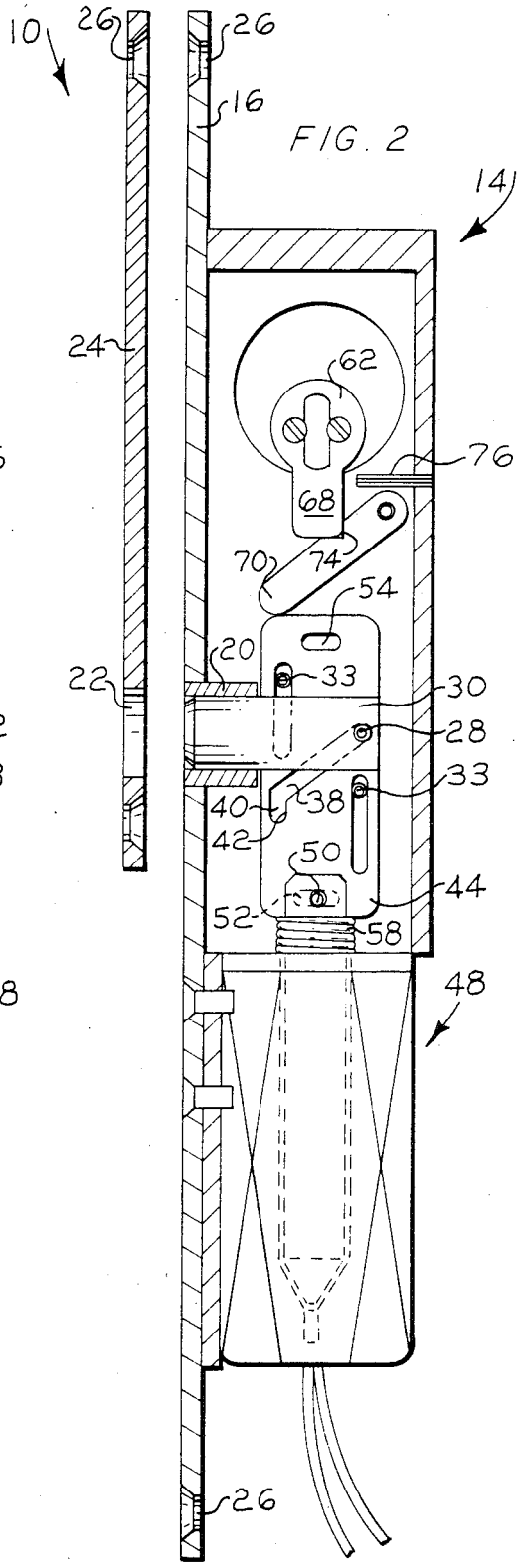
FIG. 2 is similar to FIG. 1 with the bolt in a retracted, nonlocking position.

A bolt 18 is slidably mounted in the housing assembly 14 for movement between a projected locking position as shown in FIG. 1 and a retracted, nonlocking position as shown in FIG. 2. In the projected locking position, the bolt 18 extends through a tubular bearing 20 in the lockfront 16 and an aperture 22 of a strike plate 24. The strike plate 24 is intended for mounting on a door (not shown) so as to be adjacent the lockfront 16 when the door is closed. The strike plate 24 and the lockfront 16 contain a number of screw aperatures 26 for securement to the door and frame members.

The bolt 18 has a cam-follower pin 28 rigidly connected at its inner end 30 for driving the bolt by the actuator cam plate 12 between the projected and retracted positions. The actuator plate 12 is slidably mounting within the housing 14 for movement between an upper position as shown in FIG. 1 and a lower position as shown in FIG. 2. The actuator plate 12 is slidably mounted to the housing 14 by a pair vertical guide slots 32 riding upon guide pins 33 which are rigidly connected to the housing 14.

The actuator plate 12 also has a cam slot 34 dimensioned and configured to drive the follower pin 28 and thus the bolt 18 between the projected and retracted positions. The cam slot 34 has a first end portion 36 and a second end portion 38 and extends diagonally with respect to the path of travel of the bolt 18. In the fail-secure configuration of FIG. 1, the actuator plate 12 is oriented so that the slot 34 also extends from end portion 36 to end portion 38 in a direction generally downwardly toward the path of travel of the actuator plate 12 from its upper position to its lower position.

A deadlocking slot 40, generally orthogonal to the path of travel of the bolt 18, extends downwardly from the end 38 of the cam slot 34 in obtuse angular orientation with the cam slot 34. In the locking position of FIG. 1, the cam-follower pin 28 is seated within the deadlocking slot 40 so that the inner edge 42 of the deadlocking slot 40 provides an abutment or stop to prevent inward movement of the bolt 18 such as that caused by an external driving force on the bolt 18, e.g., a jimmying of the bolt. Thus, the actuator plate 12 must be displaced downwardly to position the inner edge 42 out of direct alignment with the follower pin 28 to permit retraction of the bolt 18.

The actuator plate 12 is connected at its lower end 44 to the plunger element 46 of the solenoid assembly 48. The plunger 46 is connected to the actuator plate 12 by a pin 50 through a connector slot 52 in the lower end 44 of the actuator plate 12. The actuator plate 12 also has a corresponding connector slot 54 at its upper end 56 for connection to the plunger element 46 when the actuator plate 12 is inverted to the fail-safe configuration of FIG. 3.

A compression spring 58 is mounted about the plunger element 46 and biases the actuator plate 12 towards its upper position. Upon electrical energization of the solenoid assembly 48, the plunger 46 retracts downwardly into the position of FIG. 2 to pull the actuator plate to its lower position. Upon deenergization of the solenoid assembly 48, the compression spring 82 is of sufficient biasing force to move the actuator plate 12 to its upper position as shown in FIG. 1.

In operation, when the solenoid assembly is deenergized, the bolt 18 is in a projected locking position due to the biasing force of the compression spring 58 acting upon the actuator plate 12. That is, the compression spring 58 forces the actuator plate 12 to its upper position so that the follower pin 28 is seated within the deadlock slot 40. In this position, the bolt 18 is automatically deadlocked against any external driving force thereon. In the event of such an external driving force, the follower pin 28 abuts the inner edge of the locking slot 40 to prevent any inward travel of the bolt 18 toward the retracted, nonlocking position.

Upon energization of the solenoid assembly 48, the plunger 46 retracts to pull the actuator plate 12 downwardly toward its lower position. As the plunger 46 pulls the actuator plate 12 downwardly, the follower pin 28 rides in the vertical deadlocking slot 40 until it reaches the second end 38 of the cam slot 34. As the actuator plate 12 continues its downward travel toward the second position, the cam slot 34 drives the follower pin and thus the bolt 18 inwardly to thereby retract the bolt to its nonlocking position as shown in FIG. 2. Thus, when electrically actuated, the door lock mechanism 10 in the fail-secure mode is in an unlocked position.

Upon deenergization of the solenoid assembly 48 through electrical deactivation, power failure or the like, the plunger 46 will cease to exert a downward force on the actuator plate 12 and the compression spring 58 will bias the actuator plate upwardly from the position of FIG. 2. As the actuator plate 12 moves upwardly under the force of the compression spring 58, the follower pin 28 and thus the bolt 18 is driven outwardly toward the projected locking position. As the bolt 18 reaches the projected locking position, the follower pin 28 becomes seated in the deadlocking slot 40 for automatic deadlatching. Thus, the door lock mechanism 10 in the configuration of FIGS. 1 and 2 provides fail-secure operation with automatic deadlatching.

To obtain manual retraction of the bolt 18 from the projected locking position of FIG. 1, a manually operative rotative assembly 60 is mounted to the housing 14 adjacent the actuator plate 12. The rotative assembly 60 functions to manually drive the actuator plate 12 from its first position in FIG. 1 to its second position of FIG. 2 to consequently retract the bolt 18. The rotative assembly 60 comprises a rotatably mounted plate 62 connected to a thumb turn 64 and key mechanism 66. Angular rotation of either thumb turn 64 or key 66 in turn rotates the plate 62. The plate 62 has a cam arm 68 for driving an actuating lever 70 pivotably mounted to the housing 14 about pivot pin 72 adjacent the upper end 56 of the actuator plate 12. Upon rotation of the plate 62, the cam arm 68 drives the actuator lever 70 against the actuator plate 12 to drive the actuator plate downwardly into its lower position as shown in FIG. 2. A notch 74 in the actuating lever 70 acts as a stop to further rotational movement of the cam arm 68. The bolt 18 will remain in the retracted position of FIG. 2 as the cam arm 68 is latched within the notch 74 due to the upward biasing force of the compression spring 58. Manual counterrotation of the plate 62 will release the actuating lever 70 to allow the compression spring to move the actuator plate 12 upwardly to its upper position to drive the bolt 18 outwardly. The actuating lever 70 is biased upwardly by a torsion spring (not shown) for returning the lever 70 to its normal position against the stop pin 76. The stop pin 76 provides an upper limit for the actuating lever 70.

Figure 3:
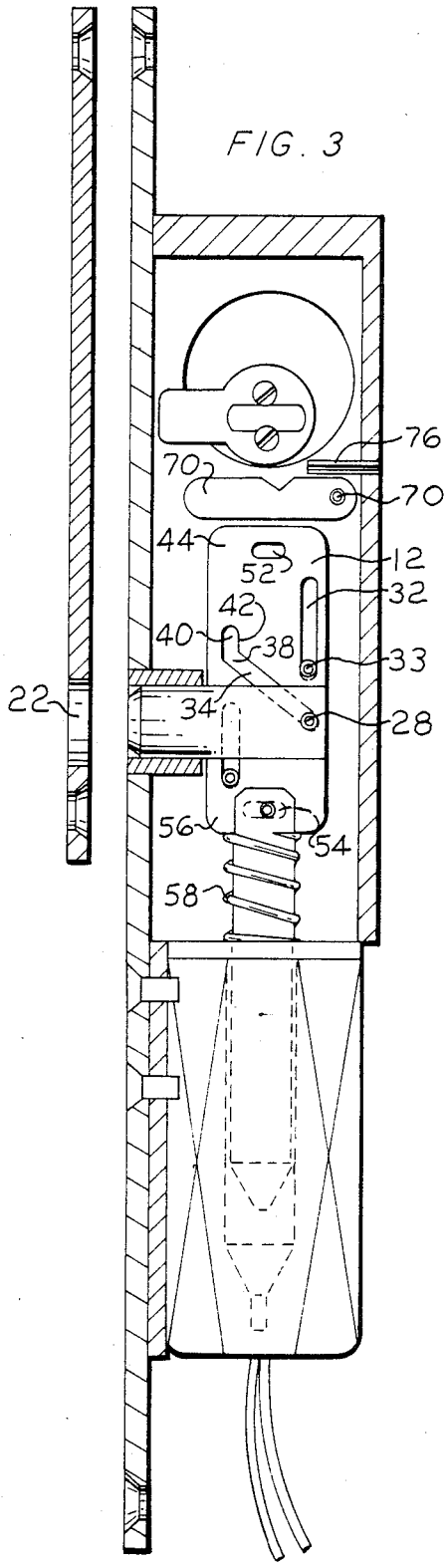
FIG. 3 is a sectional view of the electric door lock mechanism of the present invention in a fail-safe mode with the bolt in a retracted, nonlocking position.
Figure 4:
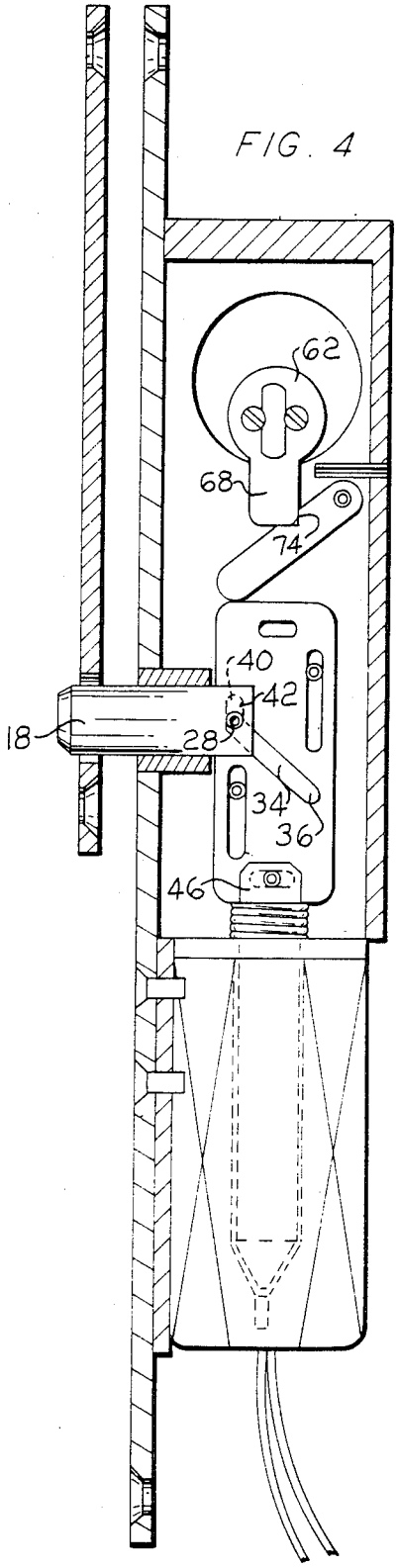
FIG. 4 is similar to FIG. 3 with the bolt in a projected locking position.
Figure 5:
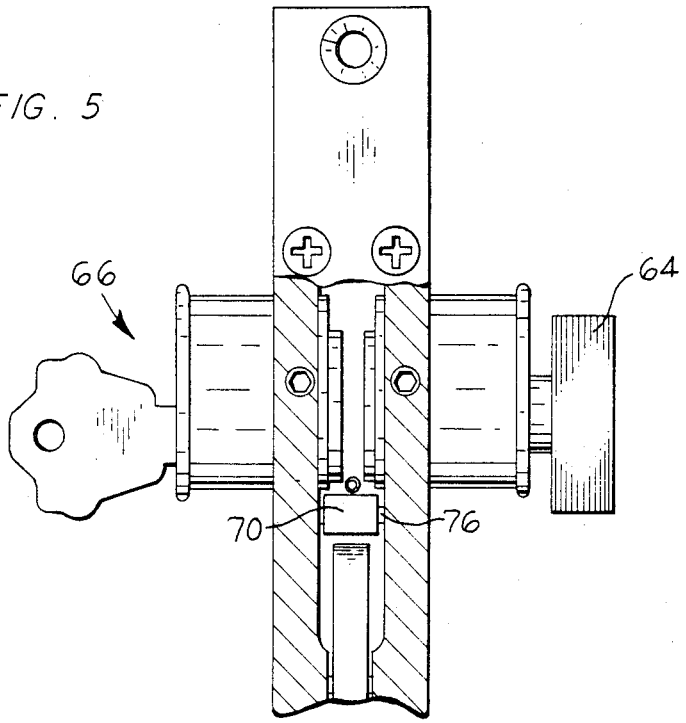
FIG. 5 is a partially broken away front view of the thumb turn and key assembly.

To convert the electric door lock mechanism from the fail-secure mode of FIGS. 1 and 2 to the fail-safe mode of FIGS. 3 and 4, the actuator plate 12 is merely inverted so that the plunger element 36 is connected to the end portion 56 of actuator plate 12 through the connector slot 54 (rather than through the connector slot 52 as in FIG. 1).

In the inverted position, the cam slot 34 of the actuator plate 12 is orientated diagonally with respect to the path of travel of bolt 18 and now extends, from end 36 to end 38, generally upwardly toward the upper position of the actuator plate 12. The deadlocking slot 40 is generally orthogonal to the path of travel of the bolt 18 and now extends upwardly from the end 38 of the cam slot 34.

Referring to FIG. 3, the solenoid assembly 48 is in a deenergized condition and the compression spring 50 holds the plate 12 in its upper position. Upon energization of the solenoid assembly 48, the plunger element 46 pulls the actuator plate 12 downwardly so that the follower pin 28 rides along the cam slot 34 to drive the bolt 18 outwardly from its retracted position to its projected position. As the bolt 18 reaches its projected position, the follower pin 28 becomes seated in the deadlocking slot 40 as shown in FIG. 4 to provide automatic deadlocking against an external driving force on the bolt 18 as previously described with respect to the mode of FIG. 1. In the position of FIG. 4, the electric door lock mechanism 10 is energized into a locked position. Upon deenergization of the solenoid assembly 48 through electrical deactivation, power failure or the like, the plunger element 46 ceases to pull downwardly on the actuator plate 12 and the compression spring 58 moves the actuator plate 12 upwardly. As the actuator plate 12 moves upwardly, the follower pin rides downwardly along the vertical deadlocking slot 40 until reaching the camming slot 34 and thereafter is driven inwardly by the camming slot 34 to retract the bolt 18 to the nonlocking position of FIG. 3. Accordingly, a fail-safe operation is attained.

The manually operative rotative assembly 60 is utilized to provide a manual projection of the bolt 18. Similar to the operation as described for FIG. 1, the manually operative rotative assembly 60 drives the actuator plate 12 downwardly to its lower position. However, because the actuator plate 12 has been inverted, the movement of the actuator plate downwardly drives the bolt 18 outwardly to a locking position to thereby provide manual projection of the bolt 18. The cam arm 68 is similarly latched within the notch 74 due to the biasing force of the compression spring 58 to maintain the bolt 18 in the projected position.

Accordingly, an electric door lock device for alternative fail-secure and fail-safe operation has been provided that will automatically deadlock the bolt when in the projected locking position of either mode of operation. By simply inverting the actuator plate 12, the electric door lock mechanism 10 is converted from a fail-safe mode to a fail-secure mode and vice versa. The door lock mechanism of the present invention is thus versatile having both fail-secure and fail-safe applications together with manual retraction in the fail-secure mode and manual projection in the fail-safe mode. The door lock mechanism is also economical to manufacture due to the relatively few operational parts.

As will be apparent to persons skilled in the art, various modifications and adaptations of the structure above described will become readily apparent without departure from the spirit and scope of the invention, the scope of which is defined in the appended claims.

I claim:

1. An electric door lock device comprising, an elongated housing for mounting in a door or frame member, a bolt slideably mounted in said housing for movement between a first position and a second position, said first position being a projected, locking position and said second position being a retracted, nonlocking position, actuator plate means for actuating said bolt between said first and second positions, said plate means being movably mounted in said housing for movement between first and second positions a solenoid means for electrically actuating said plate means from said first position to said second position, spring means for normally biasing said plate means toward said first position, and means for operationally interconnecting said bolt to said plate means for driving said bolt between said first and second positions responsive to movement of said plate means between said first and second positions, said interconnecting means including means for moving said bolt to said first position upon movement of said plate means to said first position and for moving said bolt to said second position upon movement of said plate means to said second position to provide a fail-secure operational mode and means for moving said bolt to said second position upon movement of said plate means to said first position and for moving said bolt to said first position upon movement of said plate means to said second position to provide a fail-safe operational mode, said bolt being operationally interconnnected to said plate means for driving said bolt to one of said first and second positions upon movement of said plate means from said first position to said second position and for driving said bolt to the other of said first and second positions upon movement of said plate means from said second position to said first position.

2. The device of claim 1 wherein said actuator plate means comprises means for deadlatching said bolt in said first position to resist external driving of said bolt toward said second position.

3. The device of claim 1 further comprising manually operative rotative means for mechanically moving said actuator plate means from said first position to said second position.

4. The device of claim 1 wherein said plate means is connected to said bolt for movement of said bolt to said projected locking position upon movement of said plate means to said first position whereby said spring means moves said plate means to said first position upon deenergization of said solenoid means from an actuated condition to provide fail-secure operation.

5. The device of claim 4 wherein, said bolt has a follower pin, said plate means comprises a plate element slidably mounted within said housing for movement between said first and second positions, said plate element having a cam slot with said follower pin being slidably mounted within said cam slot, said cam slot being dimensioned and configured to move said bolt to said projected locking position upon movement of said plate element to said first position and to move said bolt to said retracted nonlocking position upon movement of said plate element to said second position.

6. The device of claim 5 wherein said cam slot has a deadlatching portion abutting said follower pin when said plate element is in said first position, said deadlatching portion abutting said follower pin to prevent external driving of said bolt toward said retracted nonlocking position.

7. The device of claim 5 wherein said cam slot comprises first and second legs, said first leg extending diagonally relative to the path of travel of said bolt between said first and second positions and said second leg extending orthogonally relative to said path of travel of said bolt with said first leg moving said bolt to said projected locking position upon movement of said plate element to said first position and said second leg deadlatching said bolt in said projected locking position.

8. The device of claim 1 wherein said plate means is connected to said bolt for movement of said bolt to said retracted nonlocking position upon movement of said plate means to said first position whereby said spring means moves said plate means to said first position upon deenergization of said solenoid means from an actuated condition to provide fail-safe operation.

9. The device of claim 8 wherein, said bolt has a follower pin, said plate means comprises a plate element slidably mounted within said housing for movement between said first and second positions, said plate element having a cam slot with said follower pin being slidably mounted within said cam slot, said cam slot being dimensioned and configured to move said bolt to said retracted nonlocking position upon movement of said plate element to said first position and to move said bolt to said projected locking position upon movement of said plate element to said second position.

10. The device of claim 9 wherein said cam slot has a deadlatching portion abutting said follower pin when said plate element is in said second position, said deadlatching portion abutting said follower pin to prevent external driving of said bolt toward said retracted nonlocking position.

11. The device of claim 9 wherein said cam slot comprises first and second legs, said first leg extending diagonally relative to the path of travel of said bolt between said first and second positions and said second leg extending orthogonally relative to said path of travel of said bolt with said first leg moving said bolt to said projected locking position upon movement of said plate element to said second position and said second leg deadlatching said bolt in said projected locking position.

12. The device of claim 1 wherein, said bolt has a follower pin, said plate means comprises a plate element having a cam slot slidably mounting said follower pin, said cam slot being dimensioned and configured to move said bolt to one of said first and second positions upon movement of said plate element from said first position to said second position and to move said bolt to the other of said first and second positions upon movement of said plate element from said second position to said first position, said solenoid means being connected to said plate element for actuating said plate from said first to said second position, and said spring means normally biasing said plate element toward said first position.

13. The device of claim 12 wherein said cam slot is disposed diagonally with respect to the path of travel of said bolt between said first and second positions and extends toward the path of travel of said bolt from said second position to said first position and toward the path of travel of said plate element from said first position to said second position to provide fail-secure operation.

14. The device of claim 13 wherein, said cam slot has first and second ends, said first end being toward the path of travel of said bolt from said second position to said first position, and said plate element has a deadlatching slot generally orthogonal to the path of travel of said bolt and interconnecting with said first end of said cam slot in obtuse angular orientation with said cam slot to deadlatch said bolt in said first position to resist external driving of s id bolt toward said second position.

15. The device of claim 12 wherein said cam slot is disposed diagonally with respect to the path of travel of said bolt between said first and second positions and extends toward the path of travel of said bolt from said second position to said first position and toward the path of travel of said plate element from said second position to said first position to provide fail-safe operation.

16. The device of claim 15 wherein, said cam slot has first and second ends, said first end being toward the path of travel of said bolt from said second position to said first position, and said plate element has a deadlatching slot generally orthogonal to the path of travel of said bolt and interconnecting with said first end of said cam slot in obtuse angular orientation with said cam slot to deadlatch said bolt in said first position to resist external driving of said bolt toward said second position.

17. The device of claim 12 wherein said plate element comprises means for selective mounting in said housing in a first fail-secure orientation and alternately in a second fail-safe orientation with said cam slot being disposed diagonally with respect to the path of travel of said bolt between said first and second positions toward the path of travel said bolt from said second position to said first position and:

(a) toward the path of travel of said plate element from said first position to said second position when said plate element is mounted in a fail-secure orientation, and (b) toward the path of travel of said plate element from said second position to said first position when said plate is alternately mounted in a fail-safe orientation.

18. The device of claim 17 wherein, said cam slot has first and second ends, said first end being toward the path of travel of said bolt from said second position to said first position, and said plate element has a deadlatching slot generally orthogonal to the path of travel of said bolt and interconnecting with said first end of said cam slot in obtuse angular orientation with said cam slot to deadlatch said bolt in said first position to resist external driving of said bolt toward said second position.

19. An electric door lock device comprising an elongated housing for mounting in a door or frame member, a bolt slideably mounted in said housing for movement between a first position and a second position, said first position being a projected, locking position and said second position being a retracted, nonlocking position, actuator plate means movably mounted in said housing for movement between first and second positions, means for movably mounting said plate means in a first operational mode and alternatively in a second operational mode, cam means interconnecting said plate means and said bolt for driving said bolt to one of said first and second positions upon movement of said plate means from said first position to said second position and for driving said bolt to the other of said first and second positions upon movement of said plate means from said second position to said first position, said cam means being configured and positioned relative to said bolt and said plate means for driving said bolt to said first position upon movement of said plate means to said first position and for driving said bolt to said second position upon movement of said plate means to said second position when said plate means is mounted in said first operational mode and for driving said bolt to said second position upon movement of said plate means to said first position and for driving said bolt to said first position upon movement of said plate means to said second position when said plate means is alternatively mounted in said second operational mode, a solenoid means for electrically actuating said plate means from said first position to said second position, and spring means for normally biasing said plate means toward said first position.

20. The device of claim 19, wherein, said cam means comprises a follower pin connected to said bolt and a cam slot in said plate means, said cam slot operationally receiving said follower pin, said cam slot being dimensioned and configured to drive said bolt to said first position upon movement of said plate means to said first position and to drive said bolt to said second position upon movement of said plate means to said second position, said cam slot having a deadlocking portion to abut said pin when said bolt is in said first position to resist external driving of said bolt toward said second position.

21. The device of claim 20 wherein, said cam slot has first and second ends and is disposed diagonally with respect to the path of travel of said bolt between said first and second positions with said slot extending from said second end to said first end:

(a) toward the path of travel of said bolt from said second position to said first position and (b) toward the path of travel of said plate means from said first position to said second position, and said locking portion comprises a locking slot extending from said first end of said cam slot in obtuse angular orientation with respect to said cam slot and being generally orthogonal to the path of travel of said bolt.

22. The device of claim 19 comprising manually operative rotative means for mechanically moving said plate means from said first position to said second position for manual retraction of said bolt to said second position.

23. The device of claim 19 wherein, said cam means comprises a follower pin connected to said bolt and a cam slot in said plate means, said cam slot operationally receiving said follower pin, said cam slot being dimensioned and configured to drive said bolt to said first position upon movement of said plate means to said second position and to drive said bolt to said second position upon movement of said plate means to said first position, said cam slot having a portion to abut said pin when said bolt is in said first position to resist external driving of said bolt toward said second position.

24. The device of claim 23 wherein, said cam slot has first and second ends and is disposed diagonally with respect to the path of travel of said bolt between said first and second positions with said slot extending from said second end to said first end:

(a) toward the path of travel of said bolt from said second position to said first position and (b) toward the path of travel of said plate means from said second position to first position, and said locking portion comprises a locking slot extending from said first end of said cam slot in obtuse angular orientation with respect to said cam slot and being generally orthogonal to the path of travel of said bolt.

25. The device of claim 19 comprising manually operative rotative means for mechanically moving said plate means from said first position to said second position for manual projection of said bolt to said first position.

26. The device of claim 19 wherein said actuator plate means comprises an actuator plate detachably mounted within said housing for linear movement between said first and second positions.

27. The device of claim 19 wherein said actuator plate means comprises a single actuator plate adapted for reversible mounting within said housing.

* * * * *